US006762742B2

(12) United States Patent
Moon et al.

(10) Patent No.: US 6,762,742 B2
(45) Date of Patent: Jul. 13, 2004

(54) APPARATUS AND METHOD FOR AUTOMATIC BRIGHTNESS CONTROL FOR USE IN LIQUID CRYSTAL DISPLAY DEVICE

(75) Inventors: Seung-Hwan Moon, Seoul (KR); Sang-Soo Kim, Seoul (KR); Dong-Won Park, Seoul (KR); Hyeong-Bae Choi, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 264 days.

(21) Appl. No.: 09/961,438

(22) Filed: Sep. 25, 2001

(65) Prior Publication Data

US 2002/0122020 A1 Sep. 5, 2002

(30) Foreign Application Priority Data

Dec. 29, 2000 (KR) ..... 2000-85540
May 14, 2001 (KR) ..... 2001-26136

(51) Int. Cl.[7] ..... G09G 3/36
(52) U.S. Cl. ..... 345/102; 345/88; 345/89
(58) Field of Search ..... 345/87, 88, 89, 345/98, 99, 100, 102, 211, 212, 213, 690, 691

(56) References Cited

U.S. PATENT DOCUMENTS

| | | | | | |
|---|---|---|---|---|---|
| 5,184,117 | A | * | 2/1993 | Gauthier | 345/102 |
| 5,313,225 | A | * | 5/1994 | Miyadera | 345/102 |
| 5,315,695 | A | * | 5/1994 | Saito et al. | 345/102 |
| 5,337,068 | A | * | 8/1994 | Stewart et al. | 345/88 |
| 5,406,305 | A | * | 4/1995 | Shimomura et al. | 345/102 |
| 5,617,112 | A | * | 4/1997 | Yoshida et al. | 345/102 |
| 5,786,801 | A | * | 7/1998 | Ichise | 345/102 |
| 6,466,196 | B1 | * | 10/2002 | Isogawa et al. | 345/102 |
| 6,556,181 | B2 | * | 4/2003 | Yamada et al. | 345/88 |
| 2002/0000960 | A1 | * | 1/2002 | Yoshihara et al. | 345/87 |
| 2002/0171617 | A1 | * | 11/2002 | Fuller | 345/102 |

* cited by examiner

*Primary Examiner*—Xiao Wu
(74) *Attorney, Agent, or Firm*—McGuireWoods LLP

(57) ABSTRACT

An LCD device having a backlight generates a backlight brightness control signal in response to a duty rate signal corresponding to an average gray level or/and a color state of image data to be displayed on the LCD device and a brightness control voltage generated from the main body of the computer by user, and controls a brightness of the backlight automatically according to the backlight brightness control signal.

26 Claims, 13 Drawing Sheets

APPARATUS AND METHOD FOR AUTOMATIC BRIGHTNESS CONTROL FOR USE IN LIQUID CRYSTAL DISPLAY DEVICE

FIELD OF THE INVENTION

The present invention relates to a liquid crystal display (LCD) device, and more particularly to an apparatus and method for automatic brightness control for use in the LCD device.

BACKGROUND OF THE INVENTION

An LCD or thin film transistor liquid crystal display (TFT-LCD) module is generally used as a display device in a system such as a portable computer, a television set, and a monitor. FIG. 1 shows a structure of a general LCD module 100. Referring now to FIG. 1, the LCD module 100 comprises an LCD panel 10 for displaying all sorts of information having a liquid crystal material between two glass substrates, a driving unit having driving circuits 20, 30 for driving the LCD panel 10 and a timing controller 40 for generating control signals to control the driving circuits 20, 30, a backlight 60 for guiding light to the LCD panel 10, and a chassis (not shown) for holding and protecting the LCD panel 10 and components of the backlight 60.

The backlight 60 includes an inverter 62, a fluorescent lamp 64 such as a cold cathode fluorescent tube (CCFT) or a hot cathode fluorescent tube (HCFT), and a plurality of sheets including a reflecting sheet 66 for guiding light to the front. The backlight 60 functions to guide light from the fluorescent lamp 64 to the LCD panel 10. The LCD panel 10 displays color images by shielding or passing light from the backlight 60 through each pixel therein in response to a signal voltage of respective corresponding pixel inputted from the driving circuits 20, 30.

FIG. 2 is a block diagram showing a conventional backlight brightness control scheme of the LCD module 100 when it is used as a display device in a portable computer or a desktop computer. The portable computer or desktop computer is generally driven by the direct current, whereas the backlight 60 is lit up on by the alternating current. Thus, it is essential for the LCD module 100 to have the inverter 62 for transforming the direct current into the alternating current as shown in the drawing. The inverter 62 includes a dimming circuit (not shown) to control the brightness of the fluorescent lamp 64 as well as to transform the direct current into the alternating current, as well known in the art.

Referring to FIG. 2, in the operation, as a brightness control command is inputted by the computer operation of user, a central processing unit (CPU) or main body 200 of the computer generates a brightness control voltage CTL_V for controlling brightness, to the inverter 62. In response to the brightness control voltage $CTL__V$ from the main body 200, the dimming circuit of the inverter 62 controls an amount of current of the fluorescent lamp 64 to adjust the brightness of the backlight 60. For example, If the computer is a portable computer, the brightness control voltage CTL_V is within the range of 0 through 3.3 V. That is, when the brightness control voltage CTL_V is 0 V, a most dark brightness, i.e., black appears, and when the brightness control voltage CTL_V is 3.3 V, a most light brightness, i.e., white appears.

However, the conventional brightness control scheme of the LCD module is characterized that once the brightness is controlled, a value or level of the controlled brightness is unchanged even though the properties of data for each picture or frame to be displayed through the LCD module 100 vary. That is, the conventional brightness control scheme may raise a problem that increases the power consumption since the brightness is uniformly maintained regardless of a change in light and darkness between frames or a quick change of pictures or frames such as in motion images. Also, a picture of red (R) or blue (B) color of low transmissivity is not greatly brightened, no matter how much the brightness of the backlight may be increased. Therefore, in this case, the effect obtained through increasing the brightness is small compared to the power consumption increase.

SUMMARY OF THE INVENTION

Therefore, it is an object of the present invention to provide an improved apparatus and method for automatic brightness control for use in an LCD device, which can automatically control a brightness for each picture by controlling a duty rate for each picture automatically.

It is another object of the present invention to provide an improved apparatus and a method for automatic brightness control in an LCD device that can properly accommodate a brightness control by a user request and an automatic brightness control for each picture without conflicts therebetween.

It is other object of the present invention to provide an improved apparatus and a method for automatic brightness control for use in an LCD device which can improve a contrast for each picture displayed through an LCD module.

It is further object of the present invention to provide an improved apparatus and a method for automatic brightness control for use in an LCD device, which can reduce the power consumption of an LCD module, by controlling a brightness according to data characteristic for each picture.

It is still other object of the present invention to provide an improved apparatus and a method for automatic brightness control for use in an LCD device, which can control a brightness of backlight corresponding to a state of red (R), green (G) and blue (B) colors of a picture to be displayed in the LCD device, and thereby reduce the power consumption of the LCD module.

These and other objects are provided, according to one aspect of the present invention, by an apparatus for automatic brightness control for use in an LCD device having a backlight, comprising control signal generating means for receiving an image data to be displayed through the LCD device, calculating an average gray level of the image data, and generating a brightness control signal in proportion to the average gray level, and an inverter for controlling a brightness of the backlight automatically in response to the brightness control signal from the control signal generating means.

According to another aspect of the present invention, there is provided an apparatus for automatic brightness control for use in an LCD device having a backlight comprising, first control signal generating means for receiving an image data to be displayed through the LCD device, calculating an average gray level of the image data, and generating a first brightness control signal in proportion to the average gray level, second control signal generating means for generating a second brightness control signal to control a brightness of the backlight, by means of the operation of user, third control signal generating means for generating a third brightness control signal in response to the first and second brightness control signals from the first and second control signal generating means, and an inverter for controlling the brightness of the backlight in response to the third brightness control signal from the third control signal generating means.

According to other aspect of the present invention, there is provided a method for automatic brightness control for use in an LCD device comprising the steps of, calculating an average gray level of an image data to be displayed through the LCD device, generating a first brightness control signal in proportion to the average gray level, generating a second brightness control signal through the main body of the computer and controlling a brightness of backlight in response to a third brightness control signal generated according to the first and second brightness control signals.

According to still other aspect of the present invention, there is provided an apparatus for automatic brightness control for use in an LCD device having a backlight, which is used with a host of outputting a video information, comprising control signal generating means for receiving a pixel data corresponding to the video information, determining a color state of the pixel data, and generating a brightness control signal having a duty rate for controlling a brightness of the backlight corresponding to the determined color state, and an inverter for controlling automatically the brightness of the backlight in response to the brightness control signal from the control signal generating means.

In a preferred embodiment, the brightness control signal has a duty rate reduced in order of green, red, and blue when the determined color state is green, red, and blue. The duty rate of the brightness control signal is set to have a rate of green: red:blue=1:0.66:0.49 when the determined color state is green, red, and blue. The control signal generating means can be formed of a timing controller.

In the preferred embodiment, the control signal generating means includes a control unit for controlling various operations of the control signal generating means to determine the color state of the pixel data and to generate the brightness control signal, a pixel data acquisition and conversion unit for receiving the pixel data from the host and converting the pixel data according to the determined color state under the control of the control unit, a computing unit for computing the converted data logically and outputting a certain data under the control of the control unit, a down-counter for down-counting the certain data under the control of the control unit, and a pulse generator for generating the brightness control signal corresponding to an output signal of the down-counter. The control unit controls to generate the brightness control signal corresponding to an output signal of the down-counter until it comes to a logic low level.

According to other aspect of the present invention, there is provided a method for automatic brightness control for use in an LCD device having a backlight, which is used with a host of outputting a video information, comprising the steps of receiving a pixel data corresponding to the video information, determining a color state of the pixel data, converting the pixel data according to the determined color state, determining whether the pixel data is a last data of one horizontal line period, outputting a brightness control signal corresponding to the pixel data when the pixel data is the last data of one horizontal line period, and controlling a brightness of the backlight in response to the brightness control signal.

In a preferred embodiment, the converting step comprises converting the pixel data to have a duty rate corresponding to a brightness reduced in order of green, red, and blue when the determined color state is green, red, and blue. Preferably, the pixel data are converted into data corresponding to 100%, 66% and 49% of a maximum brightness when the determined color state is green, red, and blue, respectively.

BRIEF DESCRIPTION OF THE DRAWINGS

The foregoing and other objects, features and advantages of the invention will become more apparent from the following detailed description of preferred embodiments thereof made with reference to the attached drawings.

DETAILED DESCRIPTION OF PREFERRED EMBODIMENTS

The present invention now will be described more fully hereinafter with reference to the accompanying drawings, in which preferred embodiments of the invention are shown. Like numbers refer to like elements throughout.

Embodiment 1

An LCD device in accordance with the present invention automatically controls a brightness of backlight according to a duty rate signal generated in proportion to an average gray level of pixels to be displayed in the LCD device.

Figure 1:
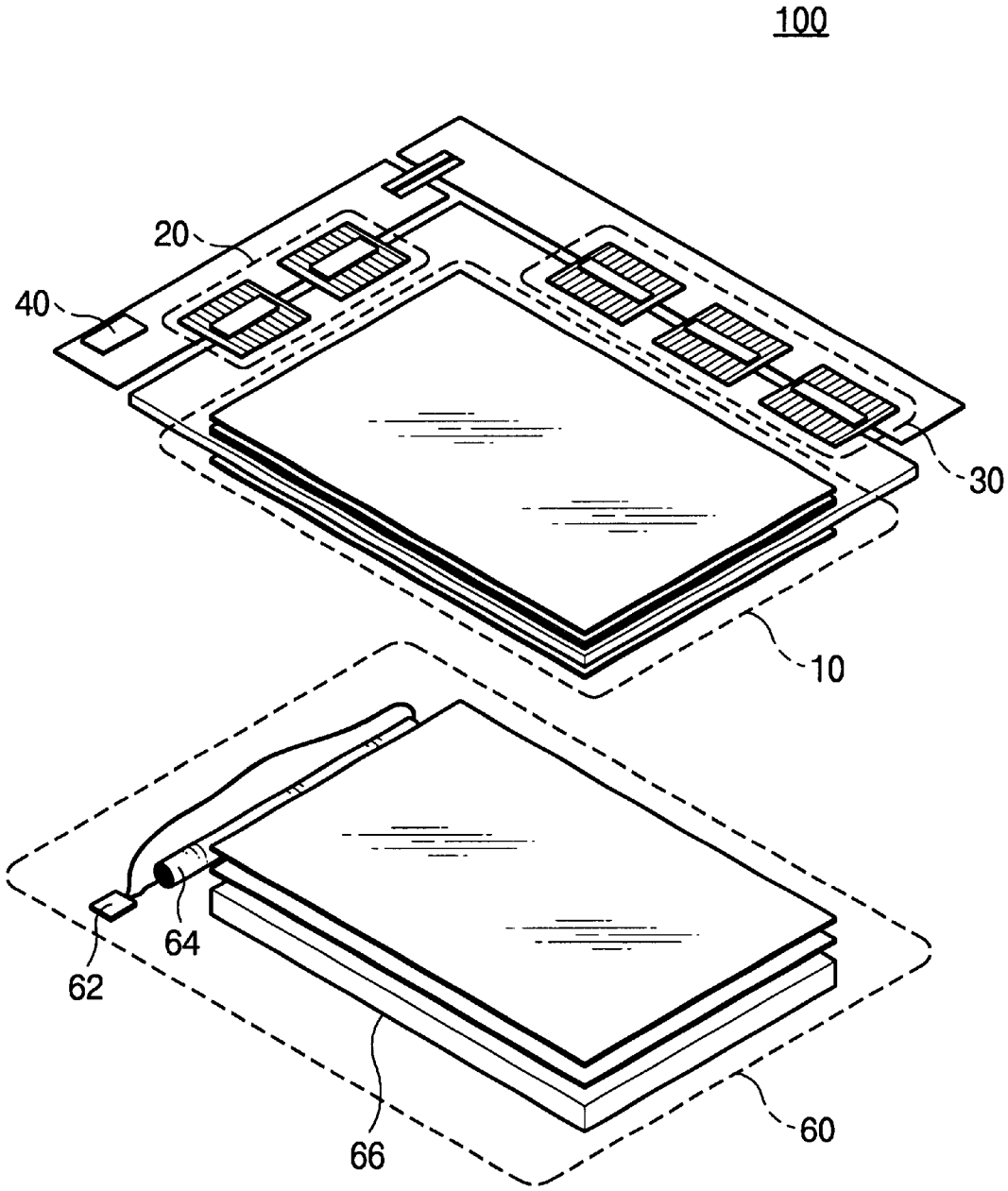
FIG. 1 is a schematic perspective view showing a structure of a general LCD module.
Figure 2:
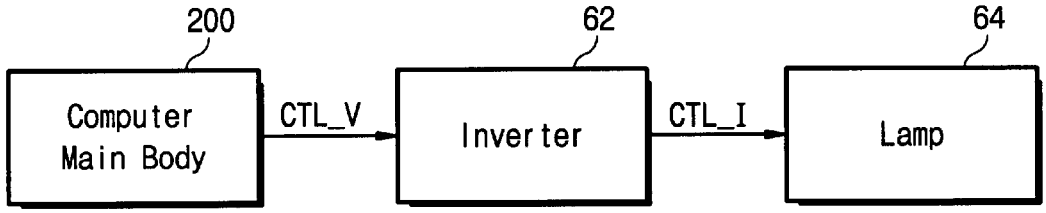
Fig. 2 (Prior Art)
FIG. 2 is a block diagram showing a conventional backlight brightness control scheme of an LCD module.
Figure 3:
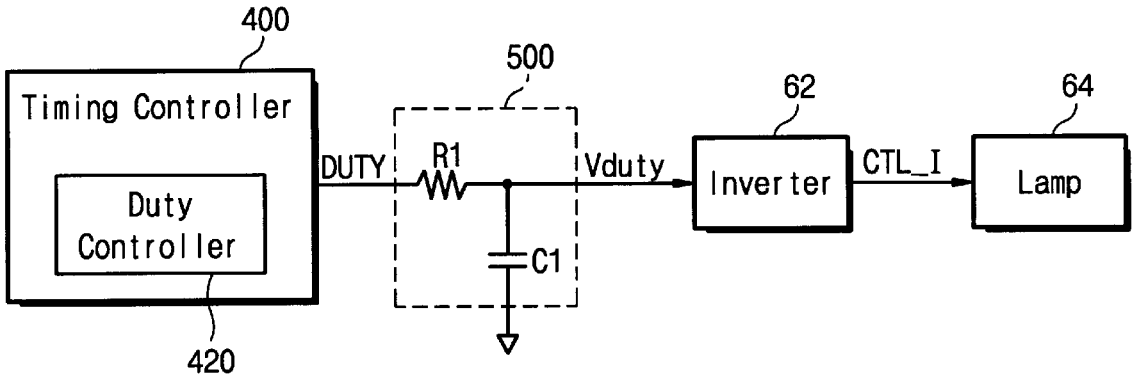
FIG. 3 is a block diagram showing a backlight brightness control scheme of an LCD module to which preferred first and second embodiments of the present invention are applied.

FIG. 3 is a block diagram showing a backlight brightness control scheme of an LCD module in accordance with a preferred first embodiment of the present invention, which is applied to a portable computer or desktop computer. Referring to FIG. 3, the LCD module includes a timing controller 400 having a duty controller 420 for calculating an average of gray levels in terms of one horizontal line period, i.e., 1H, to one picture or frame to be displayed on the LCD module and generating a duty rate signal DUTY corresponding to the calculated average value of the gray levels, and an R-C circuit 500 for summating the duty rate signals DUTY generated in terms of 1H from the timing controller 400 during one frame and generating a variable brightness control voltage Vduty that changes the electric potential in proportion to the gray levels of the picture to be displayed. An inverter 62 connected to the R-C circuit 500 controls an amount of current of a fluorescent lamp 64 through a dimming circuit (not shown) to adjust brightness of the backlight in response to the variable brightness control voltage Vduty.

The operation of the LCD module of the invention will now be described in detail with reference with the drawings.

First, the timing controller 400 outputs pulse waves in terms of 1H. Each pulse wave has a duty rate corresponding to an average value of gray levels of pixel data for 1H. For example, in an LCD module with a VGA resolution having 640 pixels for 1H, if an average value of gray levels of all pixels for 1H is 'black', a duty rate signal DUTY of 0% which outputs a logic high value as much as 0 pixel clock is generated. If an average value of gray levels of all pixels for 1H is 'white', a duty rate signal DUTY of 100% which outputs logic high values as much as 640 pixel clocks is generated. Also, if an average value of gray levels of all pixels for 1H is 'middle' grade, a duty rate signal DUTY of 50% is generated.

Tables 1 and 2 illustrated below show duty rates as percentages in an LCD module having a VGA resolution where the number of horizontal pixels is 640 and the number of an average gray level in 1 horizontal line is 16. In particular, Table 1 shows duty rates when a gamma constant is 1, whereas Table 2 shows duty rates when a gamma constant is 2.2.

TABLE 1

| GRAY LEVEL | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| DUTY [%] | 0 | 6.7 | 13.3 | 20 | 26.7 | 33.3 | 40.0 | 46.7 | 53.3 | 60.0 | 66.7 | 73.3 | 80.0 | 86.7 | 93.3 | 100 |
| PIXEL CLOCK [Number] | 0 | 43 | 85 | 128 | 171 | 213 | 256 | 299 | 341 | 384 | 427 | 469 | 512 | 555 | 597 | 640 |

TABLE 2

| GRAY LEVEL LEVEL | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| DUTY [%] | 0 | 0.3 | 1.2 | 2.9 | 5.5 | 8.9 | 13.3 | 18.7 | 25.1 | 32.5 | 41.0 | 50.5 | 61.2 | 73.0 | 85.9 | 100 |
| PIXEL CLOCK [Number] | 0 | 2 | 8 | 19 | 35 | 57 | 85 | 120 | 161 | 208 | 262 | 323 | 392 | 467 | 550 | 640 |

In Tables 1 and 2, each duty rate indicates the number of pixels having logic high values for 1H as a percentage. Accordingly, the duty rate signals DUTY generated from the timing controller 400 output pulse waves, each of which has logic high values as much as the number of pixel clocks as illustrated in Tables 1 and 2 according to the average value of the gray levels of the pixel data for 1H.

In order to generate the duty rate signals DUTY, the duty controller 420 of the timing controller 400 includes a memory buffer register (MBR) or a storage register to calculate the average value of gray levels of pixel data for 1H. For example, supposing that in case a 4 bit pixel data able to indicate 16 gray levels is inputted, an average value of gray levels to 1H among data of 1 frame is calculated, first the duty controller 420 deletes data stored in the register every 1H. Then, the duty controller 420 receives a 4 bit pixel data, summates it to a value accumulated in the register and stores the summated result in the register. And then, until a 4 bit pixel data corresponding to the end of the 1 horizontal line is inputted, i.e., all 4 bit pixel data of the 1 horizontal line are inputted, the duty controller 420 repeats the summation operation as described above. Thereafter, when all 4 bit pixel data of the 1 horizontal line are inputted, the duty controller 420 selects 4 bit data of the highest rank among a data stored in the resistor and generates a duty rate signal DUTY for 1H outputting high values as much as the number of pixel clocks shown in Tables 1 and 2. Thus, the duty rate signal DUTY for the 4 bit data expressing the 16 gray levels is generated. In case of 6 or 8 bit pixel data, the duty control principle of the duty controller 420 can be applied as the 4 bit pixel data explained above.

When the duty controller 420 generates the duty rate signal DUTY corresponding to the average gray level in terms of 1H, the R-C circuit 500 accumulates the duty rate signals DUTY generated from the timing controller 400 over 1 frame and output a variable brightness control voltage Vduty according thereto.

The operation of the R-C circuit 500 will now be described in detail.

First, supposing that an initial charged voltage of a capacitor is Vo and a signal of 1H having an amplitude Vc and a high duration time T1, i.e., a high duty rate signal (D=T1/1H*100%) is outputted from the timing controller 400, a variable brightness control voltage Vduty outputted from the R-C circuit 500 every 1H is defined as the following mathematical formula.

$$Vduty=\{Vo+(Vc-Vo)\times[1-EXP[-T1/(R\times C)]]\}\times EXP[(T1-1H)/(R\times C)] \quad \text{Mathematical formula 1}$$

As apparent from the formula, the variable brightness control voltage Vduty for controlling the brightness of the backlight has a voltage level in proportion to the high duration time T1 of the duty rate signal DUTY generated from the timing controller 400, and the response time of the variable brightness control voltage Vduty is determined by means of an RC time constant of the R-C circuit 500.

Figure 4:
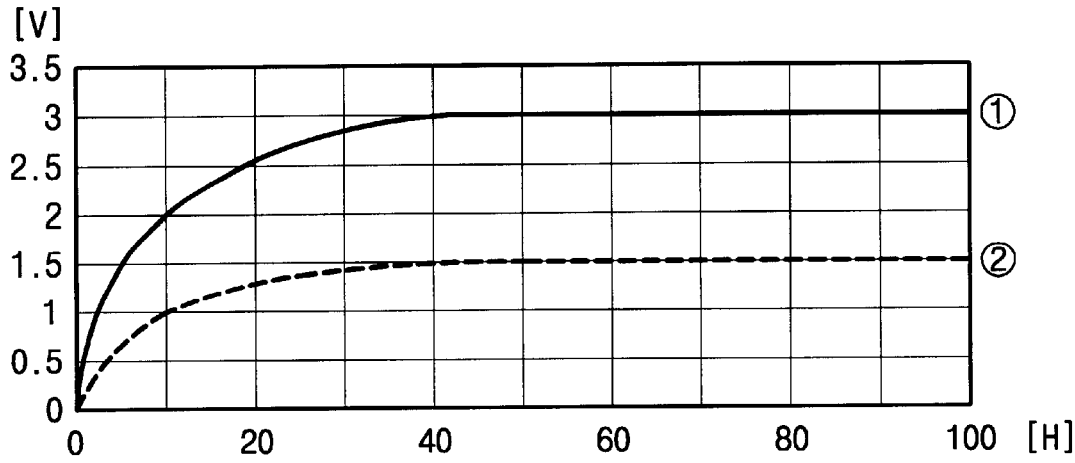
FIG. 4 is a diagram showing waveforms of a variable brightness control voltage outputted from a duty controller and an R-C circuit when the backlight brightness control scheme of FIG. 3 is applied to the first embodiment of the present invention.

FIG. 4 is a diagram showing waveforms of the variable brightness control voltage Vduty outputted from the duty controller 420 and the R-C circuit 500 shown in FIG. 3. Referring to FIG. 4, graphs 1 and 2 show waveforms of the variable brightness control voltages Vduty of 0–15 gray levels (duty rate of 100%) and a middle gray level (duty rate of 50%), respectively, when the RC time constant is ten times as much as 1H. In this case, the variable brightness control voltage Vduty comes to a saturation state at 50H. This means that the duty rate of 50H is determined by means of the RC time constant of the R-C circuit 500.

Figure 6:
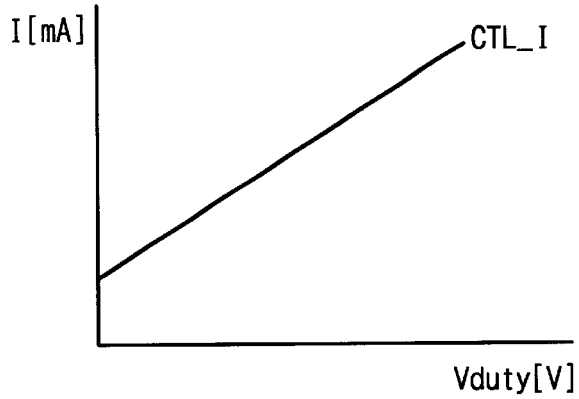
FIG. 6 is a diagram showing a relation between the current and the brightness of a lamp linearly determined according to the variable brightness control voltage outputted from the duty controller and the R-C circuit when the backlight brightness control scheme of FIG. 3 is applied to the second and second embodiments of the present invention.

FIG. 6 is a diagram showing a relation between the current and the brightness of the lamp 64 linearly determined according to the variable brightness control voltage Vduty outputted from the duty controller 420 and the R-C circuit 500 shown in FIG. 3. Referring to FIG. 6, when the variable brightness control voltage Vduty outputted from the R-C circuit 500 is used as an input voltage of the inverter 62 of the backlight, the inverter 62 generates a current CTL_I corresponding to the inputted variable brightness control voltage Vduty. The brightness of the backlight is determined in proportion to an amount of the current.

As apparent from the relation between the current and the brightness, the LCD module of the present invention generates the variable brightness control voltage Vduty by automatically controlling duty rates for one picture to be displayed thereon, and adjusts the brightness of the backlight automatically by controlling the amount of current of the lamp 64 generated through the inverter 62 according to the variable brightness control voltage Vduty.

Embodiment 2

According to another aspect of the present invention, an LCD module can automatically control a brightness of backlight by generating a variable brightness control voltage having a duty rate corresponding to a color state of pixel data from a duty controller and controlling an amount of current of the backlight, i.e., a fluorescent lamp in response to the variable brightness control voltage. Alternatively, the LCD module can be set to generate the variable brightness control voltage having the duty rate corresponding to the average gray level of the pixel data from the duty controller described with reference to the first embodiment as well as the color state of the pixel data.

Figure 7:
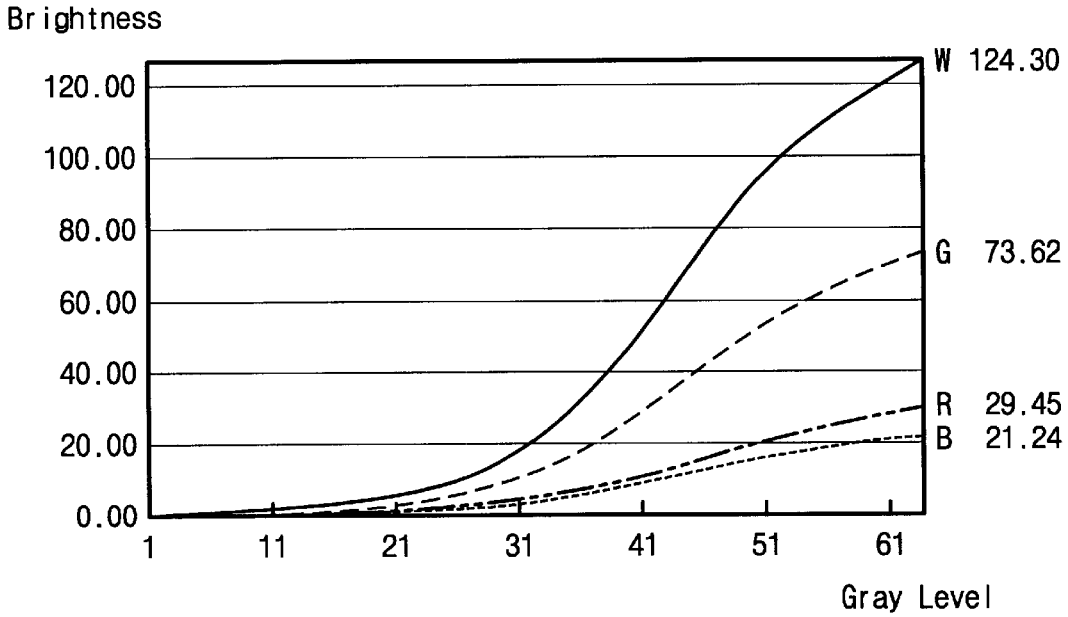
FIG. 7 is a diagram showing a brightness for each color in a general 64 gray level TFT LCD.

Referring to FIG. 7, a brightness magnitude of white is obtained by summating brightness magnitudes of green (G), red (R) and blue (B). For example, if the brightness magnitudes of the three colors are 73.62, 29.45 and 21.24 respectively, the brightness magnitude of white comes to 124.3. This means that in a color filter of the TFT LCD, the transmissivity of R, G and B is determined in order of G>R>B. Accordingly, in the present invention, when R, G and B are displayed at a same gray level, the brightness magnitude is controlled to be lowered in order of G, R and B. That is, the brightness of the backlight is maximized at G, thereby to feel the picture or image more brightly. Also, the brightness of the backlight is set to be lowered at R and B to reduce the power consumption of the LCD module. The reason is that a picture of G which shows a high transmissivity is more brightly seen even though the brightness of the backlight is slightly increased, whereas pictures of R and B which show a low transmissivity are not bright enough compared with increase of the power consumption, however much the brightness may be increased.

FIG. 3 is a block diagram showing an LCD module to which a backlight brightness control scheme in accordance with a preferred second embodiment of the present invention is applied. The composition and operation in the LCD module of the second embodiment is the same as the first embodiment, except generating a variable brightness control voltage having a duty rate corresponding to a color state of pixel data from a duty controller and controlling an amount of current of the backlight according to the variable brightness control voltage. In the embodiment, the transmissivity is set at a rate of G:R:B=1:0.66:0.49, so that pictures of G, R and B generate a maximum brightness, a half of the maximum brightness, and a quarter of the maximum brightness, respectively.

Referring to FIG. 3, the LCD module comprises a timing controller 400, an R-C circuit 500, an inverter 62, and a lamp 64.

Figure 8:
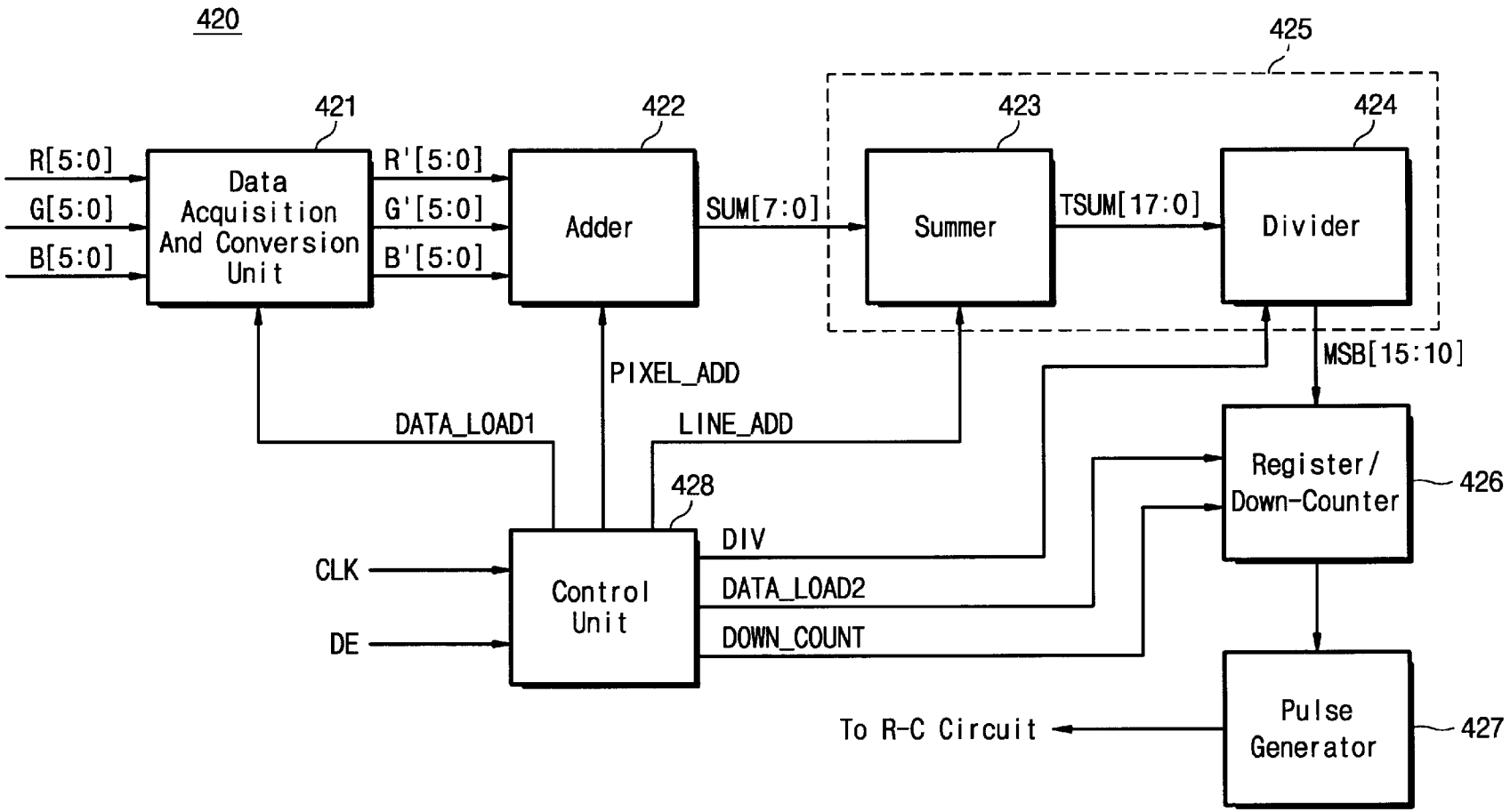
FIG. 8 is a block diagram showing the duty controller in the backlight brightness control scheme of the LCD module in accordance with the second embodiment of the present invention shown in FIG. 3.

The timing controller 400 includes a duty controller 420 and components of an integrated circuit of a general timing controller such as an input processor, a signal processor, a clock processor, and a data processor that are not shown in the drawing. The duty controller 420 generates a duty rate signal DUTY for controlling the brightness of the backlight automatically in response to a color state of a pixel data inputted from a host (not shown), for example, As shown in FIG. 8, the duty controller 420 includes a pixel data acquisition and conversion unit 421, an adder 422, a summer 423, a divider 424, a duty register/down-counter 426, a pulse generator 427 and a control unit 428.

Figure 9:
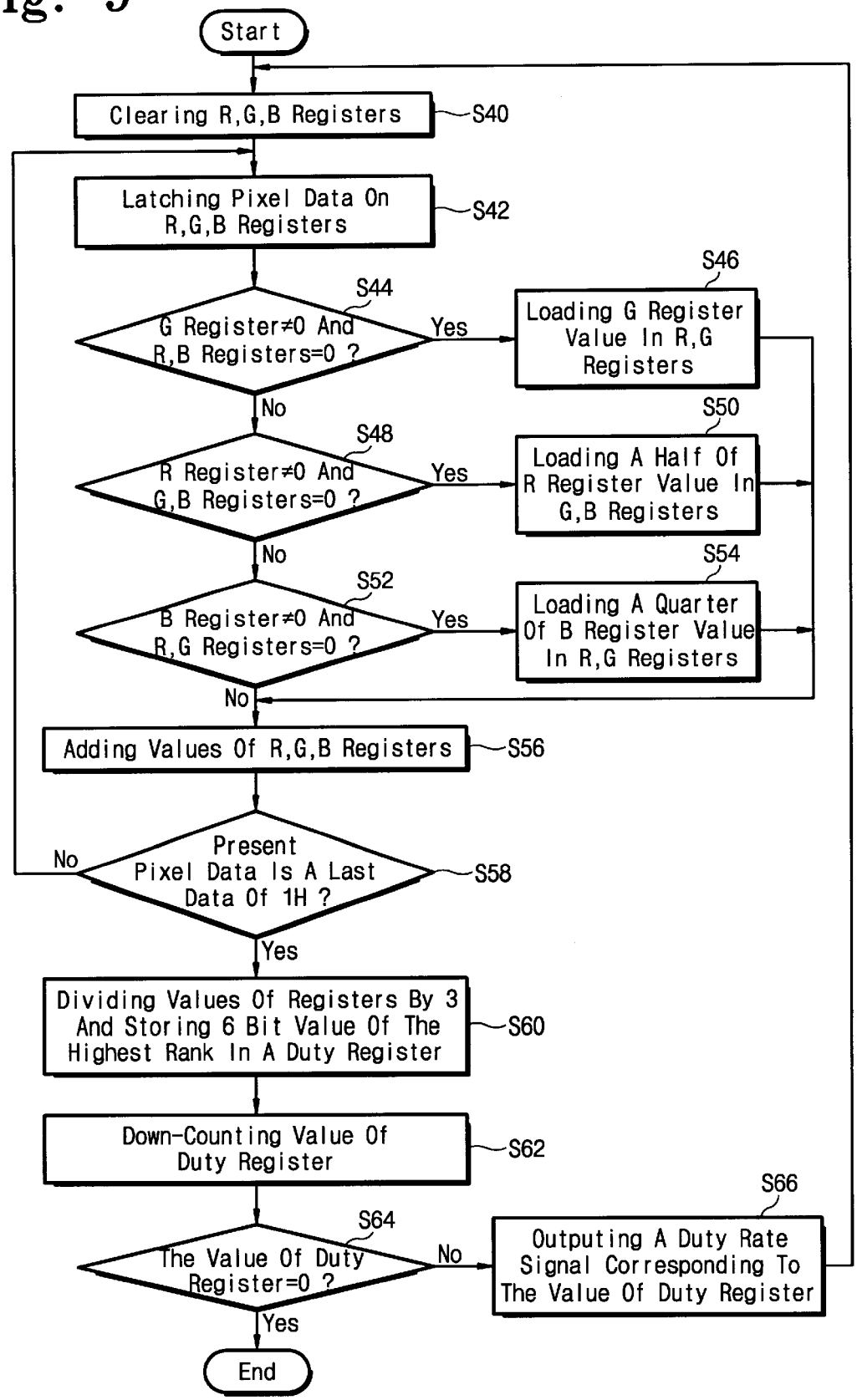
FIG. 9 is a flowchart showing an automatic brightness control program of the duty controller in the backlight brightness control scheme of the LCD module in accordance with the second embodiment of the present invention.

The pixel data acquisition and conversion unit 421, which has a plurality of memory registers, for example R, G, and B registers and accumulation registers, receives a pixel data R[5:0], G[5:0], B[5:0] from the host outputting a video information and generates a pixel data R'[5:0], G'[5:0], B'[5:0] converted according to a color state R, G, B through given processes S40 through S54 of FIG. 9. The adder 422 adds the converted pixel data R'[5:0], G'[5:0], B'[5:0] generated from the pixel data acquisition and conversion unit 421 and stores it. When the added pixel data SUM[7:0] is data for one horizontal line period 1H, the summer 423 summates the accumulated data in the adder 422 and stores the summated result. The divider 424 divides the sum total TSUM[17:0] of the pixel data for 1H outputted from the summer 423 by a divisor, for example 3. The duty register/down-counter 426 loads 6 bit data MSB[15:10] of the highest rank among data outputted from the divider 424 and down-counts them. This can set, levels for controlling the brightness according to the color state, since the 6 bit data MSB[15:10] of the highest rank correspond to 64 gray levels of white through black. The pulse generator 427 outputs a duty rate signal DUTY corresponding to an output signal of the duty register/down-counter 426 to the R-C circuit 500.

The control unit 428 receives a pixel clock signal CLK and a video signal DE having an information of 1H from the host to clear the registers (not shown) of the pixel data acquisition and conversion unit 421 periodically, and generates load signals DATA_LOAD1, DATA_LOAD2, a clock signal DOWN_COUNT, control signals PIXEL_ADD, LINE_ADD, DIV for controlling the calculation operation such as addition, summation, and division, so as to control the operation of each component of the duty controller 420 properly.

The operation of the LCD module in accordance with the second embodiment will now be described.

First, an R, G, B data of 6 bits, for example a pixel data in which G[5:0] is 111111 and R[5:0] and B[5:0] are 000000 is inputted into the pixel data acquisition and conversion unit 421 from the host. The pixel data acquisition and conversion unit 421 then converts it into a pixel data in which G'[5:0], R'[5:0] and B'[5:0] are 111111 respectively, under the control of the control unit 428. And then, the adder 422 adds the converted pixel data, i.e., G'[5:0]+R'[5:0]+B'[5:0]. As a result, the added pixel data SUM[7:0] comes to 10111101. The summer 423 receives the added pixel data SUM[7:0] and accumulates them for 1H. For example, in case of a LCD module of an XGA having 1024 pixels for one horizontal line a data TSUM[17:0] accumulated for 1H becomes to 101111010000000000, if a pixel data for 1H having G[5:0] of 111111 and R[5:0] and B[5:0] of 000000 is inputted. Thereafter, the divider 424 divides the accumulated data TSUM[17:0] by 3. The result of dividing the accumulated data TSUM[17:0] by 3 is 1111110000000000. The duty register/down-counter 426 loads 6 bit data MSB[15:10] of the highest rank among data outputted from the divider 424, into a duty register therein, and down-counts them in response to a down-count clock signal DOWN_COUNT outputted from the control unit 428. At this time, the down-count clock signal DOWN_COUNT is a clock signal having a period divided a time of 1H by the number $2^6$ (64) which can be presented by 6 bits. Accordingly, the pulse generator 427 outputs a duty rate signal DUTY corresponding to an output signal of the duty register/down-counter 426 while values of the duty register are down-counted. That is, the pulse generator 427 maintains an output signal in a high level state until the down-counted value of the duty register comes to 000000. For this, the pulse generator 427 can be formed of an 1 bit input OR gate in which each bit of the duty resistor is an input. Thus, when the pixel data in which G[5:0] is 111111 and R[5:0] and B[5:0] are 000000 is inputted, a duty rate signal of 100% which is in a high level state for 1H is outputted. Of course, when pixel data in which R[5:0] is 111111 and G[5:0] and B[5:0] are 000000, and B[5:0] is 111111 and G[5:0] and R[5:0] are 000000 are inputted, duty rate signals of 66% and 49% of a maximum brightness are respectively outputted for 1H.

Referring now to FIG. 3, the R-C circuit 500 generates a variable brightness control voltage Vduty in response to the duty rate signal DUTY from the duty controller 420. The duty rate signal DUTY has a duty rate determined according to the color state of the pixel data. For example, as described above, when the color state of the pixel data is green, red and blue, the duty rate signal DUTY has a duty rate of 100%, 66%, and 49% of the maximum brightness, respectively.

The inverter 62 receives the variable bright control voltage Vduty from the R-C circuit 500 and outputs a current CTL_I for controlling the brightness of the backlight 60, i.e., the fluorescent lamp 64. Accordingly, the brightness of the backlight 60 is automatically controlled in proportion to the current CTL_I.

Thus, in the LCD module of the invention, the duty controller 420 of the timing controller 400 outputs the duty rate signal Duty having the duty rate corresponding to the color state of the picture to be displayed, and the R-C circuit 500 generates the variable brightness control voltage Vduty according to the duty rate signal DUTY. The inverter 62 controls the amount of the current CTL_I of the fluorescent lamp 64 in response to the variable brightness control voltage Vduty to adjust the brightness of backlight 60 automatically.

Figure 5:
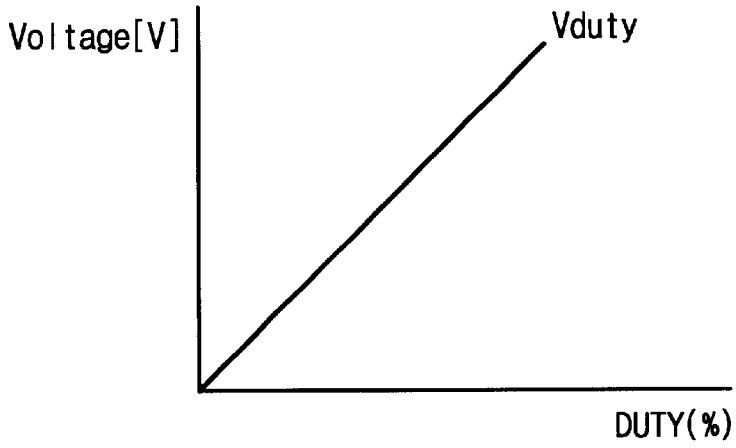
FIG. 5 is a diagram showing waveforms of a variable brightness control voltage outputted from a duty controller and an R-C circuit when the backlight brightness control scheme of FIG. 3 is applied to the second embodiment of the present invention.

FIGS. 5 and 6 are diagrams showing waveforms of the variable brightness control voltage Vduty and the output current CTL_I of the inverter 62.

Referring to FIGS. 5 and 6, the R-C circuit 500 outputs the variable brightness control voltage Vduty that is linearly determined in proportion to the duty rate signal DUTY. Accordingly, the inverter 62 generates the current CTL_I for controlling the brightness of the backlight determined linearly according to the variable brightness control voltage Vduty, and thereby the LCD module carries out an automatic brightness control function corresponding to the duty rate signal DUTY outputted according to the color state of R, G and B.

FIG. 9 is a flowchart showing an automatic brightness control program of the duty controller 420 of the LCD module in accordance with the second embodiment of the present invention. The program which are carried out by the duty controller 420 are stored in an inner memory (not shown) of the control unit 428.

Referring to FIG. 9, first the control unit 428 clears R, G, B registers of the pixel data acquisition and conversion unit 421 (S40). The R, G, B registers then latches a pixel data R[5:0], G[5:0], B[5:0] outputted from the host (S42). And then, the control unit 428 determines whether a value of the G register is not 0 and values of the R, B registers are 0, respectively (S44). When the result of the step S44 is YES, the value of the G register is loaded into the R, G registers (S46) and otherwise, the control unit 428 determines whether a value of the R register is not 0 and values of the G, B registers are 0, respectively (S48). Continually, when the result of the step S48 is YES, a half of the value of the R register is loaded into the G, B registers (S50) and otherwise, the control unit 428 determines whether a value of the B register is not 0 and values of the R, G registers are 0, respectively (S52). When the result of the step S52 is YES, a quarter of the value of the B register is loaded into the R, G registers (S54). These steps show that the pixel data R[5:0], G[5:0], B[5:0] is transformed into a data R'[5:0], G'[5:0], B'[5:0] according to the color state thereof.

Continually, when the result of the step S52 is NO, the control unit 428 controls the adder 422 to add the values of the R, G, B registers (S56). Then, the control unit 428 determines whether the present pixel data is a last data of 1H (S58). When the determined result of the step S58 is No, the operation step is returned to the second step S42 to repeat the operations of S42 through S56 as described above.

And then, when the result of the step S58 is YES, the divider 424 divides an accumulated data TSUM[17:0] of the R, G, B registers by 3 and the duty register/down-counter 426 stores 6 bit data MSB[15:10] of the highest rank among data outputted from the divider 424, in the duty register (S60). Continually, the duty register/down-counter 426 down-counts the values MSB[15:10] of the duty register (S62).

The pulse generator 427 determines whether the down-counted value of the duty register is 0 (S64). In result, when it is NO, the pulse generator 427 outputs a duty rate signal DUTY corresponding to the down-counted value of the duty register and otherwise, the program is ended.

The operation of the control unit 428 will now be described in detail by using an example which the pixel data of R, G, B explained with reference to FIG. 8 are 6 bit data, respectively.

First, the control unit 428 clears the R, G, B registers of the pixel data acquisition and conversion unit 421. The R, G, B registers then latches a pixel data R[5:0], G[5:0], B[5:0] outputted from the host.

At this time, when a value of the G register is not 0 and values of the R, B registers are 0 respectively, the value of the G register is loaded in the R, G registers. When a value of the R register is not 0 and values of the G, B registers are 0 respectively, a half of the value of the R register is loaded in the G, B registers. Also, when a value of the B register is not 0 and values of the R, G registers are 0 respectively, a quarter of the value of the B register is loaded in the R, G registers. For example, in case of 6 bit pixel data, when a value G[5:0] of the G register is 101010 and values R[5:0], B[5:0] of the R, B registers are 000000 respectively, each of the R, G, B registers loads 101010 which is the value G[5:0] of the G register. When a value R[5:0] of the R register is 101010 and values G[5:0], B[5:0] of the G, the B register are 000000 respectively, the R register loads 101010 and the G, B registers load 010101 that is a half of the value R[5:0] of the R register. In other words, the value R[5:0] of the R register is shifted one bit to the right. Also, when a value B[5:0] of the B register is 101010 and values R[5:0], G[5:0] of the R, G registers are 000000 respectively, the B register loads 101010 and the R, G registers load 001010 which is a quarter of the value B[5:0] of the B register. In other words, the value B[5:0] of the B register is shifted two bits to the right. In cases other than the three cases explained above, the operations are skipped.

Continually, the control unit 428 controls the adder 422 to add the values of R, G, B registers. The added value SUM[7:0] is then accumulated in the R, G, B registers. And then, the divider 424 divides the accumulated data TSUM [17:0] of the R, G, B registers by 3 and the duty register/down-counter 426 stores 6 bit data MSB[15:10] of the highest rank among data outputted from the divider 424, in the duty register. In succession, the duty register/down-counter 426 down-counts the values [15:10] of the duty register and at the same time, the pulse generator 427 outputs a duty rate signal DUTY having a duty rate corresponding to the value of the duty register that outputs signal of logic 1, until the down-counted value of the duty register comes to 000000. At this time, the duty rate signal DUTY has a period of 1H. Also, the down-count clock signal DOWN_COUNT is a clock signal having a period divided a time of 1H by the number $2^6$ (64) which can be presented by 6 bits.

Supposing that in case of a pixel data of white in which R[5:0], G[5:0], B[5:0] are 111111 respectively, the result of converted pixel data, i.e., R'[5:0]+G'[5:0]+B'[5:0] is 189 and a duty rate is 100%, when a pixel data G[5:0] is 111111 and pixel data R[5:0], B[5:0] are 000000 respectively, a converted pixel data R'[5:0], G'[5:0], B'[5:0] of the R, G, B registers come to 111111 respectively and R'[5:0]+G'[5:0]+B'[5:0] comes to 189, to generate a duty rate signal DUTY of 100%. Also, when a pixel data R[5:0] is 111111 and pixel data G[5:0], B[5:0] are 000000 respectively, a converted pixel data R'[5:0] of the R register comes to 111111 and converted data G'[5:0], B'[5:0] of the G, B registers come to 011111 respectively and R'[5:0]+G'[5:0]+B'[5:0] comes to 125 and generate a duty rate signal DUTY of 66%. Also, when a pixel data B[5:0] is 111111 and pixel data R[5:0], G[5:0] are 000000 respectively, a converted pixel data B'[5:0] of the B register becomes 111111 and converted data R'[5:0], G'[5:0] of the R, G registers become 001111 respectively, rendering R'[5:0]+G'[5:0]+B'[5:0] as 93 and generate a duty rat signal DUTY of 49%. That is, when a brightness of one of R, G and B is white, the duty rate signals having the duty rates of 66%, 100%, and 49% respectively are generated. Thus, according to the color state of R, G and B, a different brightness is outputted. Particularly, a brightness magnitude is reduced in the order of G, R and B, so that a contrast for each picture displayed on the LCD module can be improved and the power consumption can be reduced.

Figure 10:
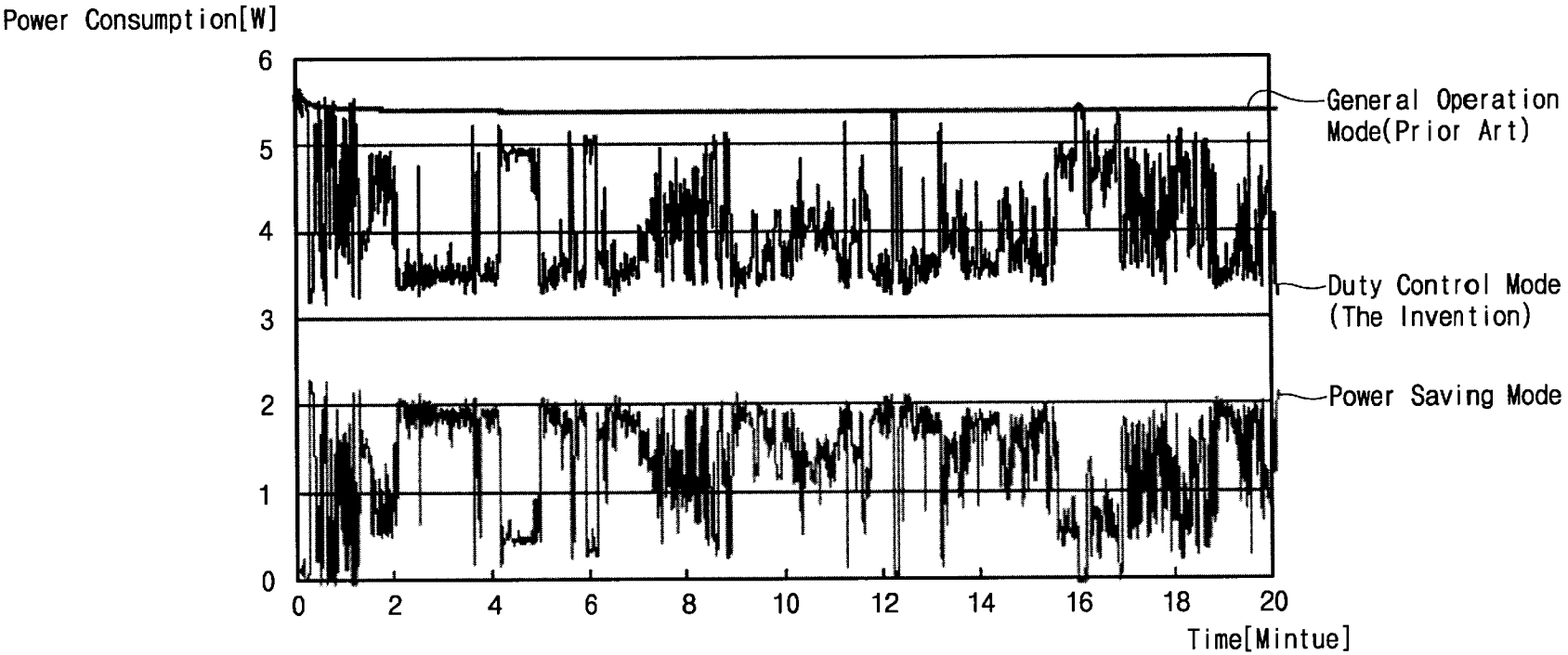
FIG. 10 a diagram showing the power consumption of the LCD module in accordance with the second embodiment of the present invention monitored in real time.

FIG. 10 shows the results of monitoring the power consumption in real time when motion images, for example, a file of DVD format are played. As shown in FIG. 10, the power consumption of the LCD module in accordance with the present invention was about 4.1W, whereas the power consumption of the conventional brightness control method was 5.4W. Accordingly, the present invention can reduce an average power consumption of about 1.3W, compared to the conventional brightness control method. Also, as shown in the below Table 3, a driving time of battery in the present invention is extended about 2.23 hours compared with the conventional brightness control method when the same batteries having a power capacity of 38Wh were used.

TABLE 3

| | The average power consumption | The driving time of battery |
|---|---|---|
| The conventional method | 5.4 W | 7.04 h |
| The invention | 4.1 W | 9.27 h |
| Improvements | 1.3 W reduced | 2.23 h lengthened |

Embodiment 3

An LCD module of the present invention can perform a brightness control requested by a user as well as an automatic brightness control for each picture. For this, the LCD module of the present invention includes a merging circuit that accommodates two control functions without conflicts. The composition of the LCD module having the merging circuit will now be explained.

Figure 11:
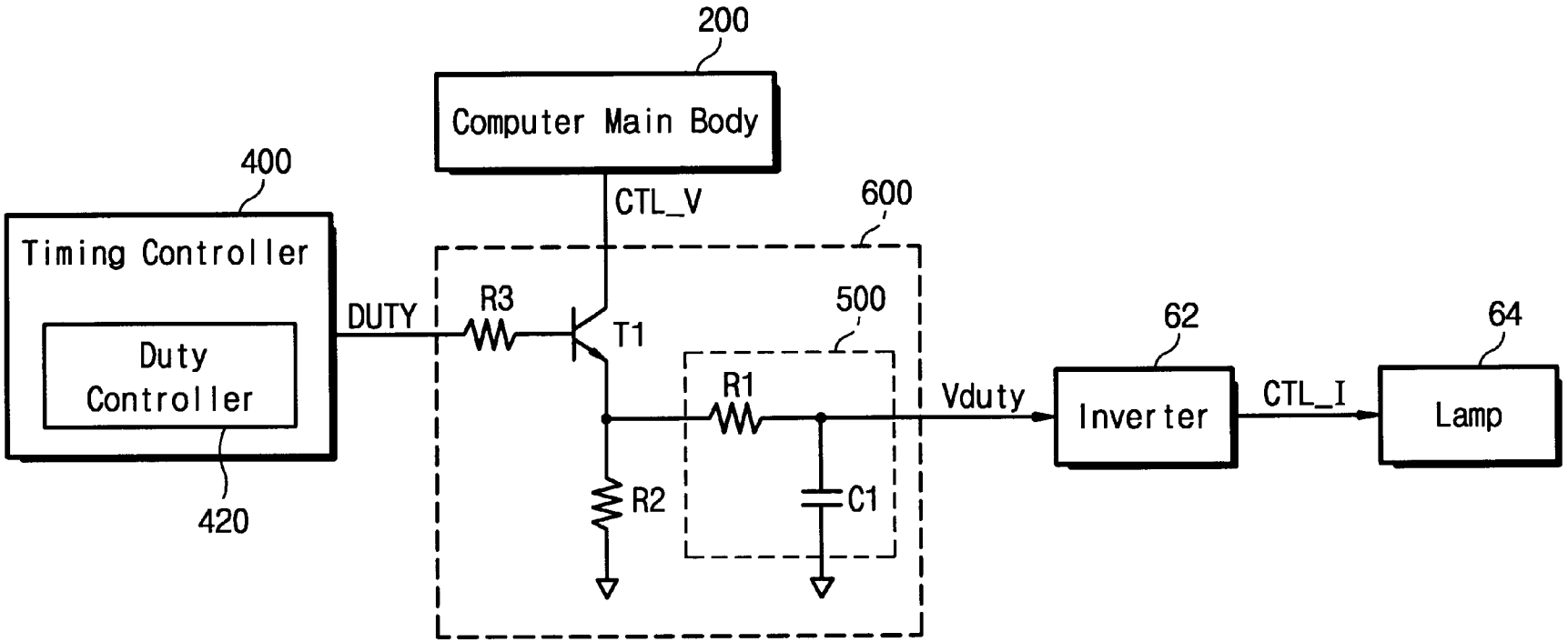
FIG. 11 is a block diagram showing a backlight brightness control scheme of an LCD module in accordance with a preferred third embodiment of the present invention.

FIG. 11 is a block diagram showing a backlight brightness control scheme of an LCD module in accordance with a preferred third embodiment of the present invention when it is used as a display device in a portable computer or a desk top computer. Referring to the drawing, the composition of the LCD module shown in FIG. 11 is the same as that of the LCD module shown in FIG. 3 except for a merging circuit 600 that generates a variable brightness control voltage Vduty to the R-C circuit 500 in response to the brightness control voltage CTL_V generated from a CPU or main body 200 of the computer and the duty rate signal DUTY generated from the duty controller 420 disposed in the timing controller 400. Accordingly, for facilitating the explanation, like numbers refer to like blocks having same function throughout. The explanation for the like blocks will not be repeated.

The merging circuit 600 includes a first transistor T1 having a base for receiving a duty rate signal DUTY in the terms of 1H connected to the timing controller 400 through the resistor R3, an emitter connected to an input end of the R-C circuit 500, and a collector for receiving the brightness control voltage from the main body 200 of the computer. T he emitter of the first transistor T1 is connected to a ground through a resistor R2. The first transistor T1 is composed of an NPN transistor. Here should be noted that the first transistor T1 forming the merging circuit is explained as an example, and other circuit elements such as NMOS transistors and operational amplifiers can be used to form it depending on the circuit design.

The first transistor T1 of the merging circuit 600 functions as a gating circuit for receiving the brightness control voltage CTL_V generated from the main body 200 of the computer and the duty rate signal DUTY generated from the duty controller 420, and outputting the brightness control voltage CTL_V selectively to the R-C circuit 500 when the duty rate signal DUTY is a high level. The R-C circuit 500 receives the brightness control voltage CTL_V selectively outputted from the merging circuit 600 to charge the capacitor C1, and generates a variable brightness control voltage Vduty by means of voltage charged to the capacitor C1. Here, it should be noted that the brightness control voltage CTL_V generated from the main body 200 of the computer can be freely set within the range of a given value by user and an electric potential of the variable brightness control voltage Vduty outputted through the R-C circuit 500 in the merging circuit 600 varies according to a gray level or/and a color state of a picture to be displayed.

For example, when a brightness control voltage CTL_V of 2V generated from the main body 200 of the computer is outputted to a terminal of the collector of the first transistor T1, the merging circuit 600 outputs a brightness control voltage CTL_V in response to a duty rate signal DUTY inputted to the base of the first transistor T1. The R-C circuit 500 charges the capacitor C1 by means of the brightness control voltage CTL_V selectively outputted according to the duty rate signal DUTY and outputs a voltage of 0–2V charged to the capacitor C1 as a variable brightness control voltage Vduty. Also, when a brightness control voltage CTL_V of 1V generated from the main body 200 of the computer is outputted to the terminal of the collector of the first transistor T1, the merging circuit 600 outputs a variable brightness control voltage Vduty of 0–1V through the R-C circuit 500 in response to a duty rate signal DUTY inputted to the base of the first transistor T1.

The duty rate signal DUTY inputted to the base of the first transistor T1 cannot only generate at the timing controller 400, but also at the LCD panel or a graphic controller (not shown) in the main body 200 of the computer. Accordingly, the merging circuit 600 can be disposed in the LCD panel or the main body 200 of the computer as well as a circuit substrate for the inverter 62 in the LCD module.

Figure 12:
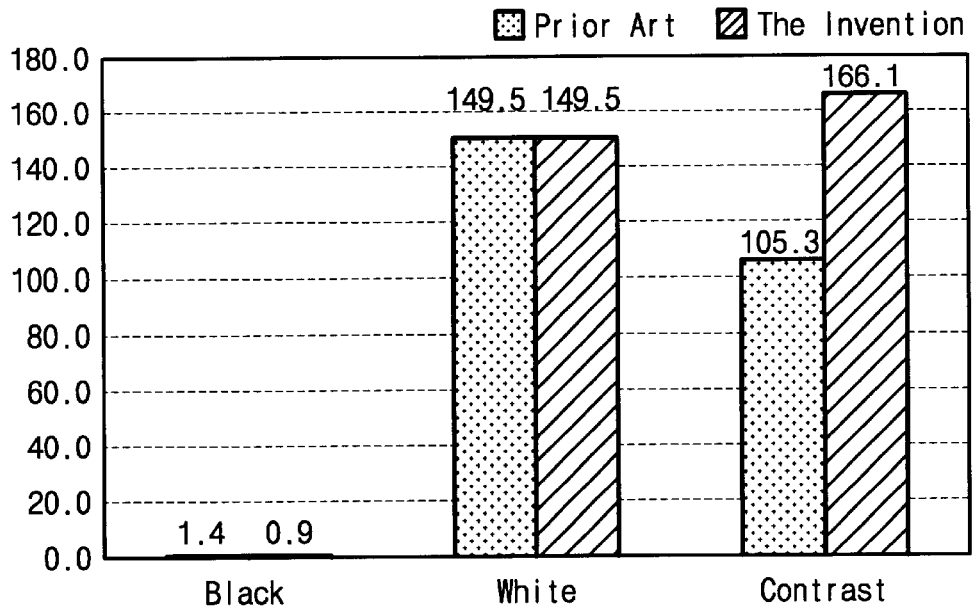
FIG. 12 is a diagram showing the results of the backlight brightness control carried out by the backlight brightness control scheme of the LCD module shown in FIG. 11 and the results of the contrast display according thereto.
Figure 13:
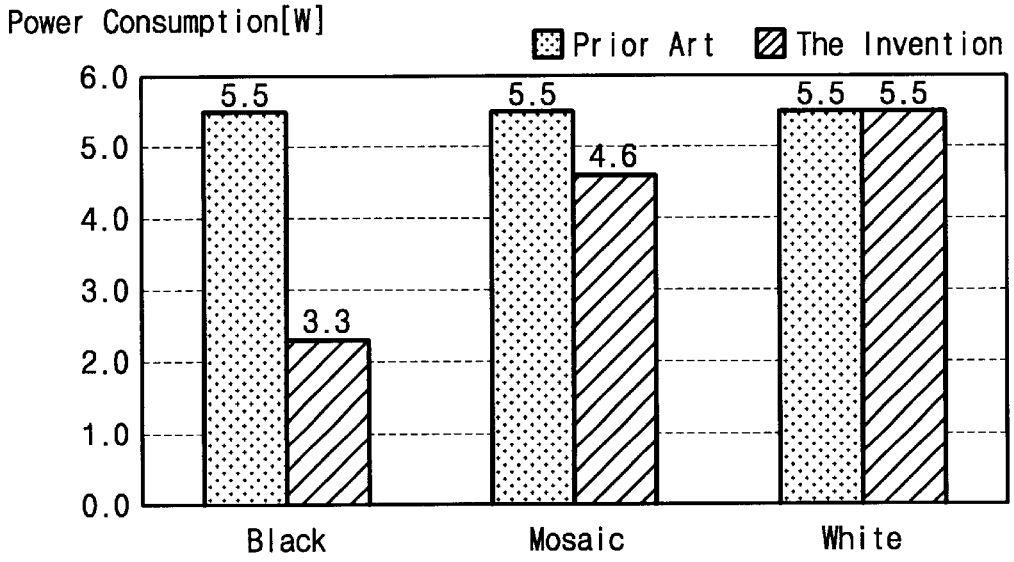
FIG. 13 is a diagram showing the power consumption when the backlight brightness is controlled by the backlight brightness control scheme of the LCD module shown in FIG. 11.

FIG. 12 is a diagram showing the results of the backlight brightness control performed by the LCD module shown in FIG. 11 and the results of the contrast display FIG. 13 is a diagram showing the power consumption according to the backlight brightness control performed by the LCD module shown in FIG. 11.

Referring to FIG. 12, it can be appreciated from the results of the backlight brightness control carried out by the LCD module of the present invention that in a dark picture such as 'black', the brightness of the invention was lower than that of the conventional technique, in a light picture such as 'white', the brightness of the invention was the same as that of the conventional technique, and 'contrast' showing the contrast of 'black' and 'white' in the invention was evidently higher than that of the conventional technique. Consequently, in the LCD module of the present invention, the contrast of 'black' and 'white' is more distinct, so that pictures to be displayed through the LCD module can be more lively felt.

Referring to FIG. 13, when the dark picture such as 'black' was displayed, the power consumption of the LCD module of the invention decreases by 2.2W than the conventional technique. When a picture such as 'mosaic pattern' representing the display of a general picture was displayed, the power consumption of the invention decreases by 0.9W than the conventional technique. Thus, since the LCD module of the present invention includes the merging circuit 600, the brightness for each picture can be actively controlled within the range of the brightness control voltage determined from the main body 200 of the computer.

Embodiment 4

In the present invention, a PNP transistor can replace the NPN transistor T1 of the merging circuit 600. The composition of the merging circuit including the PNP transistor is shown in FIG. 14.

Figure 14:
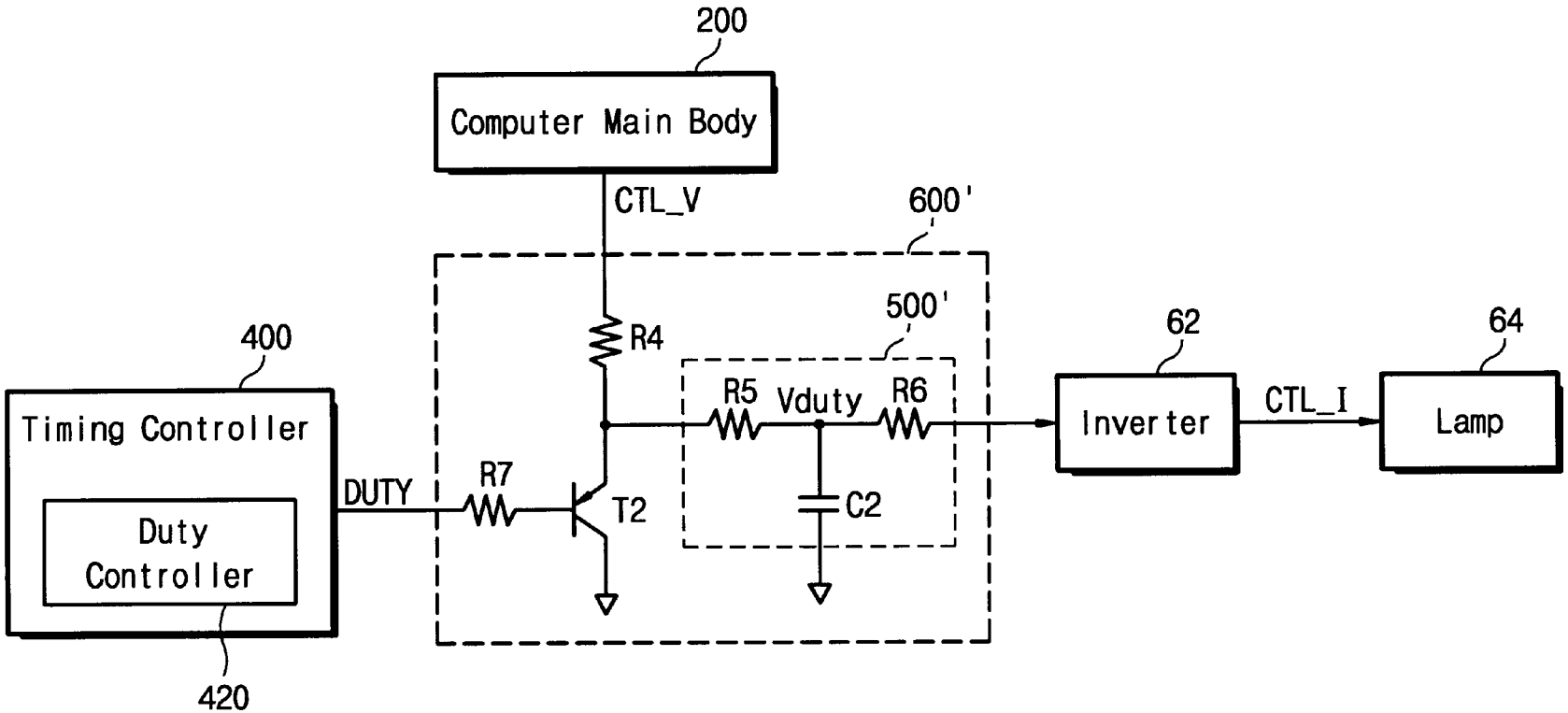
FIG. 14 is a block diagram showing a backlight brightness control scheme of an LCD module in accordance with a preferred fourth embodiment of the present invention.

FIG. 14 is a block diagram showing a backlight brightness control scheme of an LCD module in accordance with a preferred fourth embodiment of the present invention when it is used as a display device in a portable computer or a desk top computer. Referring to FIG. 14, the composition of the LCD module is the same as that of the LCD module shown in FIG. 11 except for a merging circuit 600' having the PNP transistor T2 instead of the merging circuit 600 having the NPN transistor T1, and an R-C circuit 500' having a resistor R6 connected to an output end thereof. Accordingly, for facilitating the explanation, like numbers refer to like blocks having same function throughout. The explanation for the like blocks will not be repeated.

The merging circuit 600' includes a second transistor T2 having an emitter for receiving a brightness control voltage CTL_V from the main body 200 of the computer through a resistor R4, a base for receiving a duty rate signal DUTY in the terms of 1H connected to a timing controller 400 through a resistor R7, and a collector connected to a ground. The emitter of the second transistor T2 is connected to an input end of the R-C circuit 500'.

The second transistor T2 of the merging circuit 600' functions as a gating circuit for receiving the brightness control voltage CTL_V generated from the main body 200 of the computer and the duty rate signal DUTY generated from the duty controller 420, and outputting the brightness control voltage CTL_V selectively to the R-C circuit 500' when the duty rate signal DUTY is a high level. The R-C circuit 500' receives the brightness control voltage CTL_V selectively outputted from the merging circuit 600' to charge the capacitor C2, and generates a variable brightness control voltage Vduty by means of voltage charged to the capacitor C2. It should be noted that the brightness control voltage CTL_V generated from the main body 200 of the computer can be freely set within the range of a given value by user and an electric potential of the variable brightness control voltage Vduty outputted through the R-C circuit 500' changes according to a gray level or/and a color state of a picture to be displayed. The resistor R6 connected to an output end of the R-C circuit 500' distributes the variable brightness control voltage Vduty outputted through the R-C circuit 500' at a given rate.

Here, it should be noted that in the drawing, the second transistor T2 is illustrated as a PNP transistor, but it is explained as an example and other circuit elements such as NMOS transistors and operational amplifiers can be used to form it according to the circuit design method.

Embodiment 5

In the LCD module described above, when a brightness control voltage CTL_V of 0V generated from the main body 200 of the computer is outputted, a variable brightness control voltage Vduty of 0V cannot be outputted to the R-C circuit 500' due to a base-emitter voltage Vbe of the second transistor T2 in the merging circuit 600'. Accordingly, to remove the influence of the base-emitter voltage Vbe, a level shifter is added in the LCD module, as shown in FIG. 15.

Figure 15:
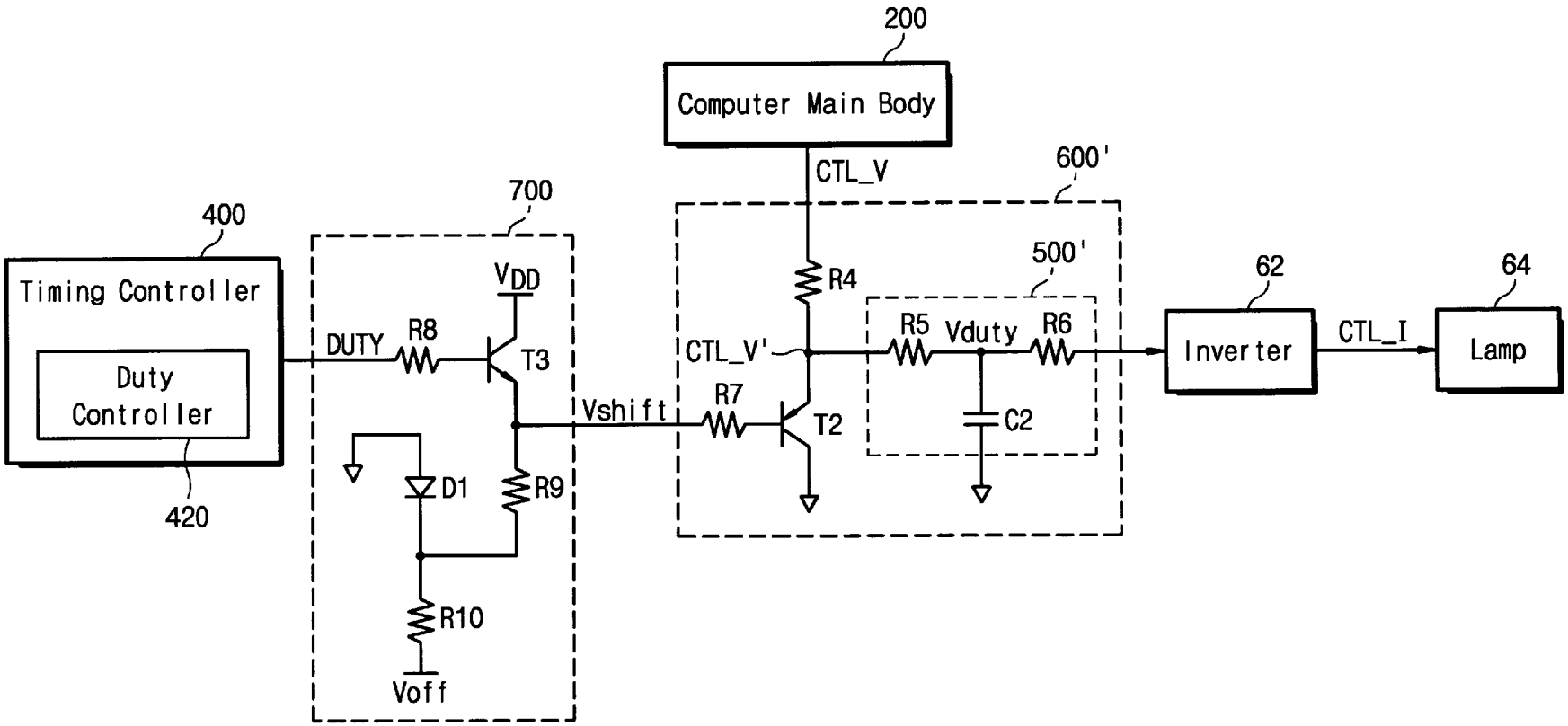
FIG. 15 is a block diagram showing a backlight brightness control scheme of an LCD module in accordance with a preferred fifth embodiment of the present invention.

FIG. 15 is a block diagram showing a backlight brightness control scheme of an LCD module in accordance with a fifth preferred embodiment of the present invention when it is used as a display device in a portable computer or a desk top computer. Referring to FIG. 15, the composition of the LCD module is similar to the LCD module shown in FIG. 14 except for a level shifter 700 interposed between the timing controller 400 and the merging circuit 600'. Accordingly, for facilitating the explanation, like numbers refer to like blocks having same function throughout. The explanation for the like blocks will not be repeated.

The level shifter 700 includes an NPN type third transistor T3 having an emitter connected to an input end of the merging circuit 600', a base connected to the timing controller 400 through a resistor R8, and a collector connected to a power source voltage $V_{DD}$, a resistor R9 having one end connected to the emitter, a diode D1 connected between the other end of the resistor R9 and a ground or earth, and a resistor R10 connected between the other end of the resistor R9 and a turn-off voltage Voff end of transistor.

The level shifter 700 generates a drop in voltage as much as a base-emitter voltage Vbe of the third transistor T3 on a current path comprising the ground, the diode D1, the resistors R9, R10, and the turn-off voltage Voff, for example, a voltage of below −5V, of the transistor and provides its drop value to a terminal of the emitter of the third transistor T3 and the resistor R9. Consequently, the transistor T2 of the merging circuit 600' is fully swung, so that even though a brightness control voltage CTL_V of 0V is outputted, a variable brightness control voltage Vduty of 0V can be outputted to the R-C circuit 500'.

Figure 16:
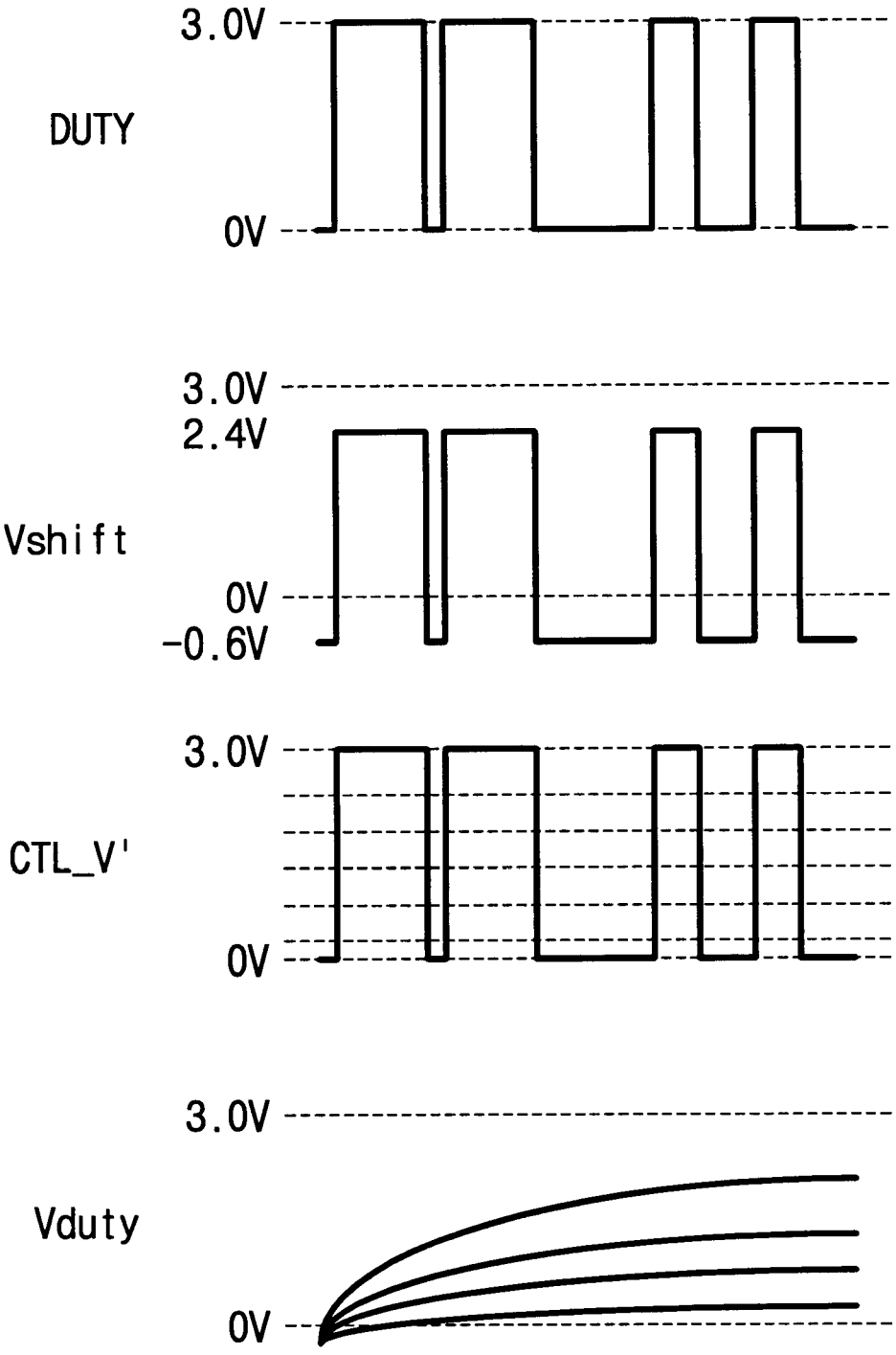
FIG. 16 is a diagram showing output waveforms at each of function blocks shown in FIG. 15.

The operation of the LCD module having the level shifter 700 will be explained with reference to FIG. 16 showing output wave forms at each node.

First, a duty rate signal DUTY of 0 to 3V generated from the timing controller 400 is inputted to the level shifter 700. When the duty rate signal DUTY is 0V, the level shifter 700 outputs a level shift voltage Vshift of −0.6V, i.e., −Vbe, whereas when the duty rate signal DUTY is 3V, i.e., the power source voltage VDD level, the level shifter 700 outputs a level shift voltage Vshift of 3V−Vbe, i.e., 2.4V. That is, the level shifter 700 generates the level shift voltage Vshift of −0.6 to 2.4V in response to the duty rate signal DUTY of 0 to 3V.

Next, when the level shift voltage Vshift generated from the level shifter 700 is inputted to the merging circuit 600' having the PNP transistor T2, the R-C circuit 500' outputs a variable brightness control voltage Vduty. For example, when the level shift voltage Vshift of −0.6V, i.e., −Vbe is inputted, an electrical potential of the emitter of the PNP transistor T2 becomes −0.6V(−Vbe)+Vbe to output a brightness control voltage CTL_V' of 0V. When the level shift voltage Vshift of 2.4V is inputted, the PNP transistor T2 outputs a brightness control voltage CTL_V' of 3V to the R-C circuit 500'. The emitter voltage CTL_V' of the PNP transistor T2, i.e., the brightness control voltage generated from the main body 200 of the computer is charged through the R-C circuit 500' and then outputted as a variable brightness control voltage Vduty. The variable brightness control voltage Vduty is outputted to the inverter 62 to control the brightness of the backlight. At the emitter voltage CTL_V' of FIG. 16, dotted lines show ranges of the brightness control voltage that can be controlled by user. Accordingly, the brightness of the backlight is automatically controlled within the ranges.

Figure 17:
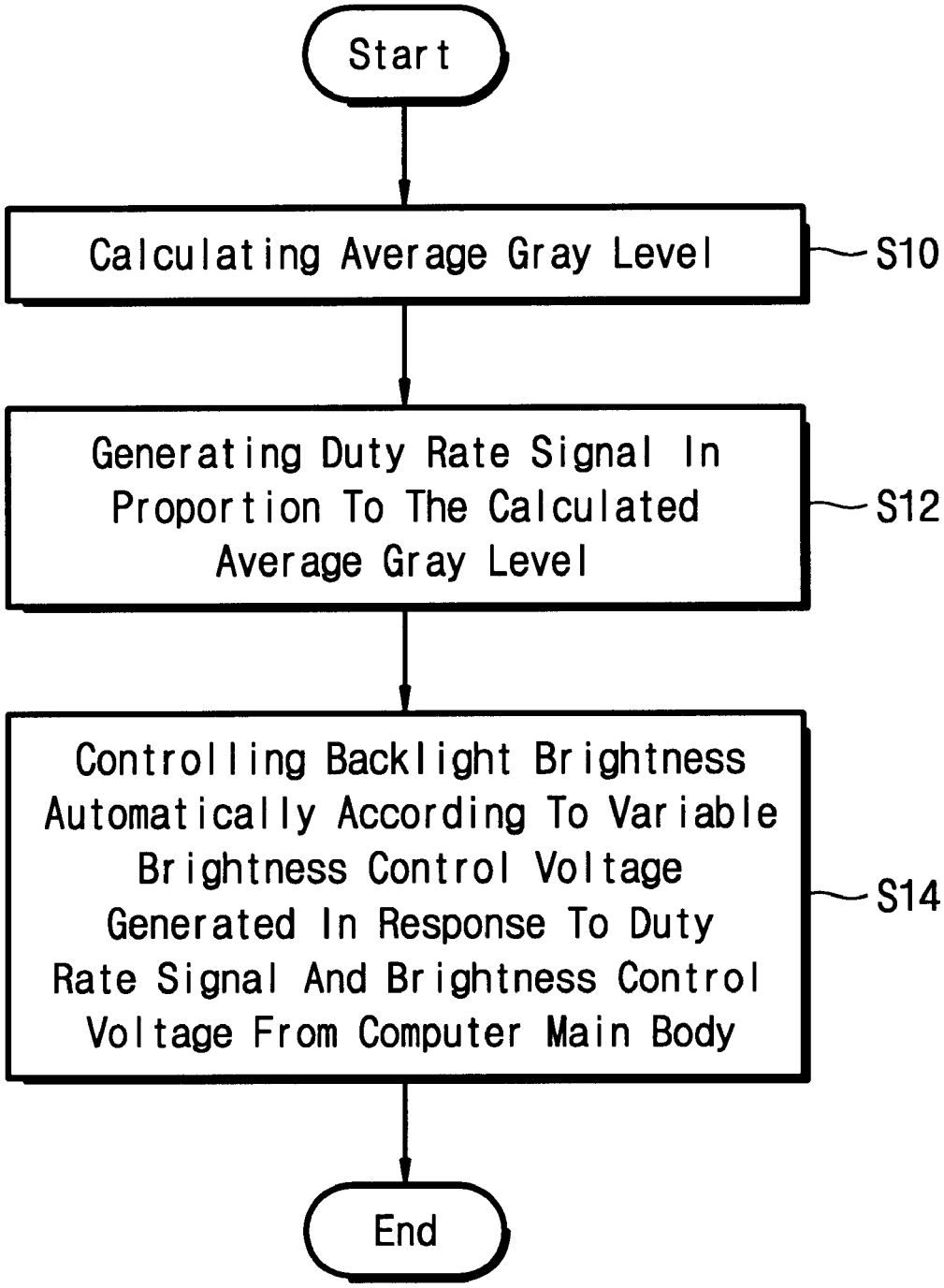
FIG. 17 is a flowchart showing an automatic brightness control method for use in an LCD module in accordance with the present invention.

FIG. 17 is a flowchart showing an automatic brightness control method of the LCD module in accordance with the present invention. Referring to FIG. 17, the duty controller 420 of the timing controller 400 calculates an average value of gray levels in terms of 1H, to pixel data to be displayed in one picture (S10). Alternatively, at the step S10, the duty controller 420 can additionally carry out an operation for determining a color state of the pixel data for 1H. Then, the duty controller 420 generates a duty rate signal DUTY corresponding to the calculated average value of the gray levels or/and the determined color state to the merging circuit 600, 600' (S12). And then, the merging circuit 600, 600' generates a variable brightness control voltage Vduty in response to the duty rate signal DUTY and a brightness control voltage generated from the main body 200 of the computer, and the inverter 62 receives the variable brightness control voltage Vduty to control the brightness of the backlight automatically (S14).

Thus, the LCD module in accordance with the present invention merges the duty rate signals DUTY generated from the duty controller 420 of the timing controller 400 and the brightness control voltage CTL_V generated from the main body 200 of the computer by user setting, to control the brightness of the backlight automatically. As a result, as shown in FIGS. 12 and 13, the contrast for each picture displayed on the LCD module can be improved and thereby the power consumption can be reduced.

As apparent from the foregoing description, the present invention can automatically control the brightness for each picture by controlling the duty rate for each picture automatically.

Also, the present invention can properly combine the brightness control by a user request and the automatic brightness control function for each picture without conflicts.

Further, the present invention can improve the contrast for each picture displayed in the LCD module, and thereby reduce the power consumption of the LCD module.

Still further, the present invention can control the brightness of the backlight automatically by generating the variable brightness control voltage having the duty rate corresponding to the color state of pixel data from the duty controller, and thereby reduce the power consumption of the LCD module to extend battery usage in the system such as the portable computer.

Also, the present invention can control to feel pictures or images more brightly and thereby to experience a cubic effect when the pictures are changed from a dark color to a bright color since a brightness change of white and black for R, G and B colors is greatly enhanced by controlling the brightness according to the color state of R, G, and B of the pixel data.

In the drawings and specification, there have been disclosed typical preferred embodiments of the invention and, although specific terms are employed, they are used in a generic and descriptive sense only and not for purpose of limitation, the scope of the invention being set forth in the following claims.

What is claimed is:

1. An apparatus for automatic brightness control for use in an LCD device having a backlight, comprising:

control signal generating means for receiving an image data to be displayed on the LCD device, calculating an average gray level of the image data, and generating a brightness control signal in proportion to the average gray level; and an inverter for automatically controlling brightness of the backlight in response to the brightness control signal from said control signal generating means.

2. The apparatus for automatic brightness control according to claim 1, wherein said control signal generating means is one selected from a timing controller, a graphic controller, and an LCD panel.

3. An apparatus for automatic brightness control for use in an LCD device having a backlight, comprising:

first control signal generating means for receiving an image data to be displayed on the LCD device, calculating an average gray level of the image data, and generating a first brightness control signal in proportion to the average gray level;

second control signal generating means for generating a second brightness control signal to control brightness of the backlight by user operation;

third control signal generating means for generating a third brightness control signal in response to the first brightness control signal and the second brightness control signal from said first control signal generating means and said second control signal generating means; and an inverter for controlling the brightness of the backlight in response to the third brightness control signal from said third control signal generating means.

4. The apparatus for automatic brightness control according to claim 3, wherein said first control signal generating means is one selected from a timing controller, a graphic controller, and a LCD panel, and said second control signal generating means is a computer.

5. The apparatus for automatic brightness control according to claim 3, wherein said third control signal generating means includes:

a gating circuit for selectively outputting the second brightness control signal generated from said second control signal generating means when the first brightness control signal generated from said first control signal generating means is a high level; and an R-C circuit for accumulating the second brightness control signal outputted selectively from the gating circuit, and generating the third brightness control signal.

6. The apparatus for automatic brightness control according to claim 5, wherein said R-C circuit includes:

a resistor connected between said first control signal generating means and said inverter; and a capacitor connected between the resistor and ground.

7. The apparatus for automatic brightness control according to claim 5, wherein said gating circuit includes a transistor having one end connected through a first resistor to said first control signal generating means, another end connected with said second control signal generating means and the other end connected through a second resistor to ground.

8. The apparatus for automatic brightness control according to claim 7, wherein the transistor is one selected from an N-type transistor and a P-type transistor.

9. The apparatus for automatic brightness control according to claim 7, wherein the transistor can be a circuit element such as a calculation amplifier.

10. The apparatus for automatic brightness control according to claim 8, further including a level shift circuit for swinging the transistor fully by lowering a voltage level of the first brightness control signal outputted from said first control signal generating means as much as a given level when the transistor is a P-type transistor.

11. The apparatus for automatic brightness control according to claim 10, wherein the level shift circuit includes:

a transistor having a current passage connected in serial between a power source for supplying voltage and said third control signal generating means, and a control end connected to said first control signal generating means;

a third resistor connected in serial to the current passage of said transistor;

a diode connected in serial between said third resistor and the ground; and a fourth resistor connected in parallel with said diode.

12. The apparatus for automatic brightness control according to claim 3, wherein the third brightness control signal forming a variable brightness control voltage satisfies the following formula:

$$Vduty=\{Vo+(Vc-Vo)\times[1-EXP[-T1/(R\times C)]]\}\times EXP[(T1-1H)/(R\times C)].$$

13. The apparatus for automatic brightness control according to claim 3, wherein said control signal generating means further includes a function that determines a color state of the image data and then make the brightness control signal to have a duty rate for controlling the brightness of the backlight corresponding to the determined color state.

14. The apparatus for automatic brightness control according to claim 13, wherein said duty rate of said brightness control signal is reduced in order of green, red, and blue when the determined color state is green, red, and blue.

15. The apparatus for automatic brightness control according to claim 14, wherein the duty rate of the brightness control signal is set to have a rate of green:red:blue= 1:0.66:0.49 when the determined color state is green, red, and blue.

16. The apparatus for automatic brightness control according to claim 14, wherein said control signal generating means is a timing controller.

17. The apparatus for automatic brightness control according to claim 14, wherein said control signal generating means includes:

a control unit for controlling various operations of said control signal generating means to determine the color state of the image data and to generate the brightness control signal;

a pixel data acquisition and conversion unit for receiving the image data and converting the image data according to the determined color state, under the control of said control unit;

a computing unit for computing the converted data logically and outputting a certain data, under the control of said control unit;

a down-counter for down-counting the certain data under the control of said control unit; and a pulse generator for generating the brightness control signal corresponding to an output signal of said down-counter, wherein said control unit controls to generate the brightness control signal corresponding to the output signal of said down-counter until it comes to a logic low level.

18. A method for automatic brightness control for use in an LCD device, comprising the steps of:

calculating an average gray level of image data to be displayed on said LCD device;

generating a first brightness control signal in proportion to the average gray level;

generating a second brightness control signal generated from the main body of the computer;

generating a third brightness control signal in response to the first brightness control signal and the second brightness control signal; and controlling a brightness of said backlight in response to said third brightness control signal.

19. An apparatus for automatic brightness control for use in an LCD device having a backlight used with a host of outputting a video information, comprising:

control signal generating means for receiving a pixel data corresponding to said video information, determining a color state of said pixel data, and generating a brightness control signal having a duty rate for controlling a brightness of the backlight to correspond to the determined color state; and an inverter for controlling the brightness of the backlight automatically in response to said brightness control signal from said control signal generating means.

20. The apparatus for automatic brightness control according to claim 19, wherein the brightness control signal has a duty rate reduced in order of green, red, and blue when the determined color state is green, red, and blue.

21. The apparatus for automatic brightness control according to claim 20, wherein the duty rate of the brightness control signal is set to have a rate of green:red:blue= 1:0.66:0.49 when the determined color state is green, red, and blue.

22. The apparatus for automatic brightness control according to claim 20, wherein said control signal generating means is a timing controller.

23. The apparatus for automatic brightness control according to claim 20, wherein said control signal generating means includes:

a control unit for controlling various operations of said control signal generating means to determine the color state of the pixel data and to generate the brightness control signal;

a pixel data acquisition and conversion unit for receiving the pixel data from the host and converting the pixel data according to the determined color state, under the control of said control unit;

a computing unit for computing the converted data logically and outputting a certain data, under the control of said control unit;

a down-counter for down-counting the certain data under the control of said control unit; and a pulse generator for generating the brightness control signal corresponding to an output signal of said down-counter, wherein said control unit controls to generate the brightness control signal corresponding to the output signal of said down-counter until it comes to a logic low level.

24. A method for automatic brightness control for use in an LCD device having a backlight used with a host of outputting a video information, comprising the steps of:

receiving a pixel data corresponding to the video information;

determining a color state of the pixel data;

converting the pixel data according to the determined color state;

determining whether the pixel data is a last data of one horizontal line period;

outputting a brightness control signal corresponding to the pixel data when the pixel data is the last data of one horizontal line period; and controlling a brightness of the backlight in response to the brightness control signal.

25. The method for automatic brightness control according to claim 24, wherein said converting step further comprises converting said pixel data to have a duty rate corresponding to a brightness reduced in order of green, red, and blue when the determined color state is green, red, and blue.

26. The method for automatic brightness control according to claim 25, wherein the pixel data are converted into data corresponding to 100%, 66% and 49% of the maximum brightness when the determined color state is green, red, and blue, respectively.

* * * * *